United States Patent [19]

Schivley

[11] Patent Number: 4,834,441

[45] Date of Patent: May 30, 1989

[54] DRILL PIPE HANDLING DEVICE

[75] Inventor: George P. Schivley, Richardson, Tex.

[73] Assignee: Ingersoll-Rand Company, Woodcliff Lake, N.J.

[21] Appl. No.: 125,252

[22] Filed: Nov. 25, 1987

[51] Int. Cl.[4] ..... B66C 1/66; E21B 19/06

[52] U.S. Cl. ..... 294/90

[58] Field of Search ..... 294/86.1, 86.33, 90, 294/91, 102.2, 104; 166/77.5, 98; 175/423

[56] References Cited

U.S. PATENT DOCUMENTS

| | | | |
|---|---|---|---|
| 98,459 | 12/1869 | Good | 294/90 |
| 504,599 | 9/1983 | Lockwood | 294/90 X |
| 1,014,955 | 1/1912 | Double et al. | 294/91 |
| 1,021,984 | 4/1912 | Holmes | 294/90 |
| 1,371,835 | 3/1921 | Angus | 294/90 |
| 2,875,982 | 3/1959 | Unglesby | 294/90 X |
| 3,052,003 | 9/1962 | Eyler et al. | 294/91 X |
| 3,193,116 | 7/1964 | Kenneday et al. | 294/91 X |
| 3,434,191 | 3/1969 | Timmons | 294/86.1 |
| 3,675,278 | 7/1972 | Powell | 294/102.2 |

FOREIGN PATENT DOCUMENTS

| | | | |
|---|---|---|---|
| 2178718 | 2/1987 | United Kingdom | 294/90 |

*Primary Examiner*—Johnny D. Cherry
*Attorney, Agent, or Firm*—Arthur N. Trausch

[57] ABSTRACT

A device to facilitate the handling of drill pipe which obviates the necessity of climbing the drill rig tower to attach or detach the lifting device. The device comprises a collar which is temporarily attached to the drill pipe and a basket device having a lifting bail.

4 Claims, 2 Drawing Sheets

DRILL PIPE HANDLING DEVICE

FIELD OF THE INVENTION

This invention relates to a device for handling of drill pipe and more particularly to a combination pipe ring and elevator for lifting plain end drill pipe.

BACKGROUND OF THE INVENTION

U.S. Pat. No. 1,021,984 to F. H. Holmes discloses an elevator for handling drill pipe. The device includes a dismountable strap adapted to surround the pipe beneath the coupling. The strap comprises two semiannular members hinged to each other. Bails are connected to the strap for lifting. This type of device works only with pipe provided with end couplings of a larger diameter than the pipe.

U.S. Pat. No. 3,675,278 to Thurman Powell discloses an elevator device for encircling, gripping and holding plain end well casing. The elevator includes multiple hinged frame and latch segments surrounding the pipe. The segments have wedge shaped slips on their inner diameter for gripping the pipe. Springs force the wedges into gripping contact with the pipe.

Plain end drill pipe and drill casing are commonly used today. This type of pipe and casing have threaded pin and box-ends so that radially overhanging end couplings of a larger diameter are not required. Typically plain-end type pipe and casing has parallel flat surfaces recessed into their outer diameter along secant lines at each end of the pipe. The flat surfaces provide a surface for the drill rig wrenches to grip the pipe when adding or removing pipe sections from the drill string.

It is desirable to handle plain end well drilling pipe and casing simply and reliably. The Holmes type device requires a larger diameter coupling to be on the drill pipe in order for the strap to lift it. Alternatively, some type of larger diameter member such as a lug has to be permanently or temporarily put on the drill pipe. The Powell device uses the wedging action of the slips to hold the pipe in the elevator collar. However, it is not desirable to rely on springs or latches to accomplish the gripping of a section of drill pipe since the pipe may slip from the collar when lifted.

The present invention overcomes the above shortcomings by taking advantage of the flat recessed surfaces near the ends of the drill pipe to temporarily attach a collar. The collar is axially fixed in position by the shoulders of the flat surfaces. A basket assembly with appropriate lifting bails can then be used to safely lift a section of drill pipe.

SUMMARY OF THE INVENTION

Thus it is a primary object of this invention to provide a mechanically simple, reliable, easy to use drill pipe lifting assembly.

Another object of this invention is to provide a simple, reliable, and safe lifting assembly that can be used on plain end drill pipe that is in common use today.

In general, the foregoing objects are obtained by an elevator assembly having a bifurcated collar and an annular basket assembly with lifting bails attached.

DESCRIPTION OF THE PREFERRED EMBODIMENT

Figure 1:
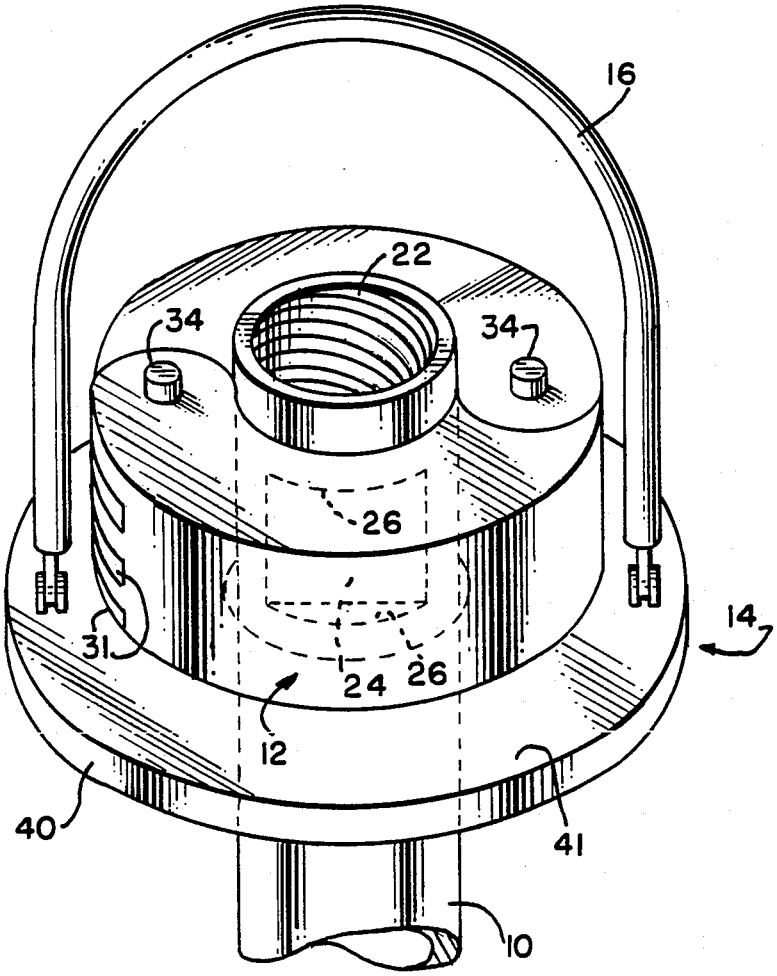
FIG. 1 is a side elevation view of the present invention engaging a drill pipe.

Referring now to the drawings wherein like reference numerals designate identical or corresponding parts throughout the several views and more particular to FIG. 1, the present invention will now be described. The invention is shown engaging a section of plain end drill pipe 10. A bifurcated collar assembly 12 is temporarily attached near the end of the drill pipe. An annular basket assembly 14 having lifting bail 16 is positioned around the pipe and underneath the collar.

Figure 2:
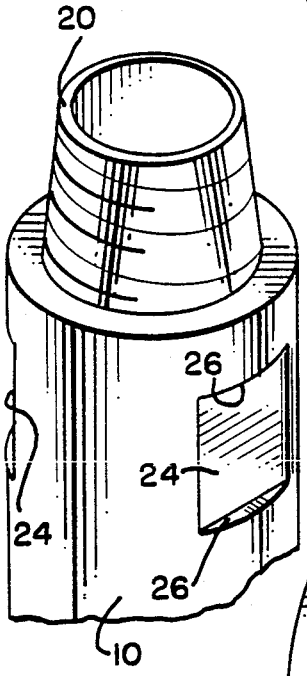
FIG. 2 is a side view of common drill pipe.

Referring now to FIG. 2 a section of drill pipe 10 in common use today is shown. A drill pipe section has a pin-end 20 as shown in FIG. 2 and a box-end 22 shown in FIG. 1. The pipe sections are joined together to form a drill pipe string. The box end has internal threads which mate with the tapered threads of the pin-end.

Near each end of the drill pipe section 10 are a pair of parallel flats 24. The flats provide a surface for the drill rig breaking wrench to attach or break the connection between adjacent drill pipe sections in the string. The flats are recessed from the outer diameter surface of the pipe and have shoulders 26 perpendicular to the outer diameter surface of the pipe.

Figure 3:
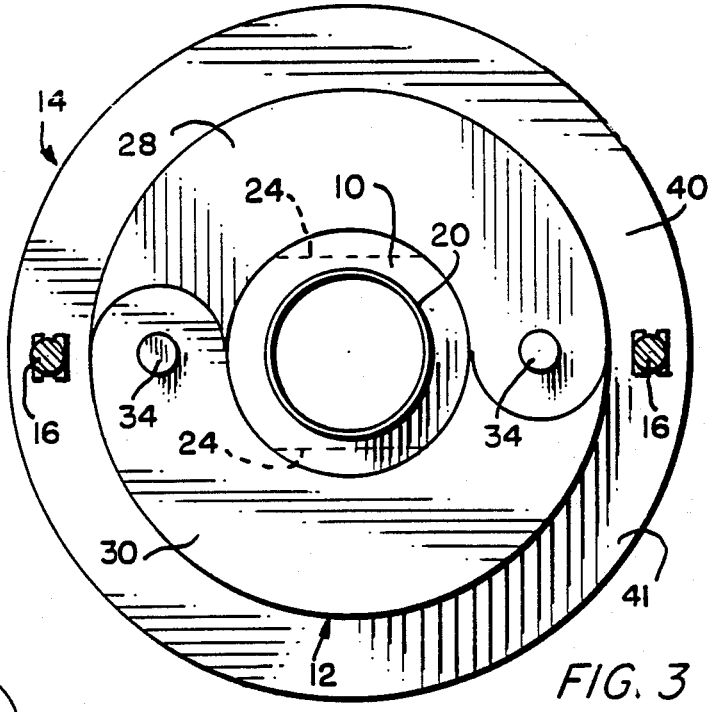
FIG. 3 is a top view of the present invention showing the collar engaging a drill pipe.
Figure 4:
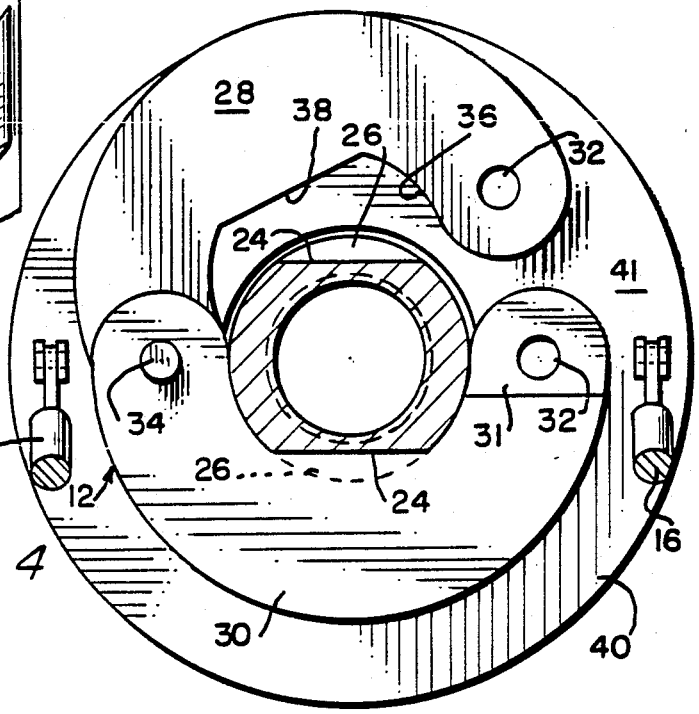
FIG. 4 is a top view of the present invention showing the open collar surrounding a drill pipe.

Referring now to FIGS. 1, 3, and 4, the bifurcated collar assembly 12 will now be described.

The collar includes two semiannular segments 28 and 30 having meshing lugs and ears 31 at each end. When meshed, bores 32 are aligned through the lugs and ears so that hinge pins 34 can secure the segments together. The collar has an axial dimension such that it fits within the flat surface 24 between the end surfaces 26. As best seen in FIG. 4, the interior diameter of each semiannular segment 28 and 30 has substantially a concaved shape 36 dimensioned to accept the rounded outer diameter of the drill pipe. Each collar segment also has a straight portion 38 which mates with the flat sections 24 of the drill pipe to axially fix the collar 12 on the drill pipe. The straight portions 38 abut the flat portions 24 and are axially located between the shoulders 26 of the flat section when the collar segments are closed around the pipe.

A basket assembly 14 includes an annular flange member 40 adapted to easily slide over the drill pipe outer diameter. The flange has an outer diameter dimension such that top surface 41 will provide a lifting surface on the bottom of the collar 12. Lifting bails 16 are provided on the basket assembly so as to allow the assembly to be lifted by the drill rig hoist.

In operation the basket assembly 14 is slipped over the end of the drill pipe. The bifurcated collar 12 is then put in place over the flats 24 near the end of drill pipe. The hinged segments are pivoted into a closed position around the pipe and pinned. The hoist line is then attached to the lifting bail 16 of the basket and the drill pipe is lifted up and loaded into the pipe transfer arm of the drill rig. The rotor head is attached to the drill pipe section and the drilling process is continued. The basket assembly 14 can be removed off the bottom of the drill pipe when the drill pipe is hanging from the rotary head prior to resuming the drilling process. Alternatively the basket can be removed off the top of the drill pipe after the collar 12 has been removed when the rotary head has brought the drill pipe end to the platform level.

To lift a string of drill pipe from the hole, the basket assembly 14 is slipped over the upper end of the drill pipe at the platform level. The collar 12 is then attached near the upper end of the drill pipe over the flats 24. Then the rotary head can be brought down and screwed onto the drill pipe to pull the drill string out of the hole. After a pipe section is pulled out of the hole the joint connection is broken at the bottom and the rotary head unscrewed at the top. The pipe section remains suspended from the hoist line by the basket and collar assembly. The pipe can then be lowered and stacked for storage. The collar and basket can easily be removed during this operation.

It should be noted that this device allows the operator to perform all the pipe handling including the attaching and disassembly steps at the platform level. Also this pipe handling device can be used when the pipe is being run pin-end up and box-end down or vice versa since the flats are typically provided near both ends of the drill pipe.

Numerous modifications and variations of the present invention are possible in light of the above teachings. It is therefore to be understood that the invention may be practiced other than as specifically described herein and it is intended that the invention be limited only by the language of the following claims.

I claim:

1. A lifting device for drill pipe comprising:

a bifurcated collar having two semiannular members hinged to each other at each end to form a ring around said drill pipe, said semiannular members having generally concaved inner diameter surfaces surronding a straight secant portion adapted to abut flat surfaces on said drill pipe; and a basket assembly having at least one lifting bail and an annular lifting flange cooperative with said collar to axially support said collar when the pipe is lifted.

2. A lifting device for pipe having flat recesses on the outer circumference, said device comprising an annular collar assembly and a basket assembly, said collar assembly comprising:

two semiannular members having inner diameter surfaces adapted to engage the flat recesses of said pipe, each semiannular member having two engageable ends; and means for securing the engaged ends so as to form a collar around the flat recesses of the pipe;

said basket assembly comprising:

an annular lifting member having an inner diameter opening dimensioned to slidably fit around the pipe outer circumference and a surface portion dimensioned to axially abut the collar assembly; and at least one lifting bail connected to said lifting member.

3. The lifting device of claim 2 wherein said semiannular members have generally concaved inner diameter surfaces on each side of a straight secant portion.

4. The lifting device of claim 3 wherein said engageable ends further comprise a plurality of meshable axially alternating lug and ear portions; and wherein said securing means comprise axially aligned bores through the meshed lug and ear portions of each end and corresponding hinge pins.

* * * * *